US007374164B2

(12) United States Patent
Gaissert et al.

(10) Patent No.: US 7,374,164 B2
(45) Date of Patent: May 20, 2008

(54) CONFIGURATION FOR THE TRANSPORT AND SIMULTANEOUS ALIGNMENT OF SHEETS

(75) Inventors: Eberhard Gaissert, Gruibingen (DE); Wolfram Hofmann, Gagernberg/Beistein (DE); Lars Rathjen, Ludwigsburg (DE); Rüdiger Schlien, Freiberg Am Neckar (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 370 days.

(21) Appl. No.: 11/123,457

(22) Filed: May 5, 2005

(65) Prior Publication Data

US 2005/0248081 A1 Nov. 10, 2005

(30) Foreign Application Priority Data

May 5, 2004 (DE) ..... 10 2004 022 141

(51) Int. Cl.
*B65H 29/32* (2006.01)
*B65H 9/16* (2006.01)

(52) U.S. Cl. ..... 271/197; 271/276; 271/250; 271/251

(58) Field of Classification Search ..... 271/197, 271/250, 248, 251, 108, 194, 276, 176
See application file for complete search history.

(56) References Cited

U.S. PATENT DOCUMENTS 4,579,330 A * 4/1986 Lehmann ..... 271/11
4,647,033 A * 3/1987 Emrich ..... 271/276
4,651,984 A * 3/1987 Emrich ..... 271/237
5,058,876 A * 10/1991 Grossmann ..... 271/98
5,600,906 A * 2/1997 Hamid ..... 38/143
5,971,134 A * 10/1999 Trefz et al. ..... 198/460.1
7,125,014 B2 * 10/2006 Dolz et al. ..... 271/197
2002/0158410 A1 10/2002 Dolz et al.

FOREIGN PATENT DOCUMENTS

| | | |
|---|---|---|
| DE | 1 260 378 | 2/1968 |
| DE | 1 786 252 | 1/1972 |
| DE | 34 10 029 C1 | 8/1985 |
| DE | 37 24 712 A1 | 3/1988 |
| DE | 44 21 918 C1 | 9/1995 |
| DE | 102 13 705 A1 | 10/2002 |

* cited by examiner

*Primary Examiner*—Patrick Mackey
*Assistant Examiner*—Luis A Gonzalez
(74) *Attorney, Agent, or Firm*—Laurence A. Greenberg; Werner H. Stemer; Ralph E. Locher

(57) ABSTRACT

A configuration for the transport and simultaneous alignment of sheets has a straightedge, at least one conveyor belt disposed slightly at an angle to the straightedge in the direction of movement of the sheets, and an air suction device. The conveyor belt exhibits open transverse slots on its upper side carrying the sheets. The upper half of the conveyor belt runs in a guide channel that is open in an upward direction, and the transverse slots are connected to the air suction device in such a way as to permit the flow to take place. A controller is provided to control the supply of air in the area of the transverse slots.

13 Claims, 4 Drawing Sheets

CONFIGURATION FOR THE TRANSPORT AND SIMULTANEOUS ALIGNMENT OF SHEETS

BACKGROUND OF THE INVENTION

Field of the Invention

The invention relates to a configuration for the transport and simultaneous alignment of sheet material, in particular made of paper, board or films, with a straightedge and with at least one conveyor belt, disposed slightly at an angle to the straightedge in the direction of movement of the sheet, and an air suction device.

A configuration of this kind for the transport and simultaneous alignment of sheet material is previously disclosed in German patent DE 34 10 029 C1. The conveyor belt running slightly at an angle to the straightedge is provided in this case with a plurality of perforations, which are disposed above a suction channel that is open to the perforations. The sheet material, once it has been placed on the conveyor belt, is retained on the conveyor belt by the generated suction effect and is transported to the straightedge in order to align it accurately for the subsequent further processing stages. As a consequence of the suction effect, however, and in particular in the case of very thin, soft materials, there is a risk in this case of the sheet material being held too firmly on the conveyor belt, with the result that it cannot be aligned exactly and that folds may form in the area between the straightedge and the conveyor belt.

Reference is also made to these difficulties in published, non-prosecuted German patent application DE 37 24 712, which shows a similar configuration, in conjunction with which the conveyor belt does not exhibit any perforations, however. This publication instead proposes the configuration, next to the conveyor belt or between a number of conveyor belts, of suction openings in a guide plate, which lead into a subjacent suction channel. The conveyor belt in this case projects in full or in part above the surface of the guide plate. This results in the formation along the conveyor belt of suction slots, as a consequence of which, viewed over the entire surface of the conveyor, the suction forces are distributed in an irregular fashion, and problems such as the formation of folds or the snagging of the edges of the transported sheets and inadequate alignment can occur.

Contrary to the theory, therefore, in conveyor and alignment configurations of this kind, the adhesion between the sheet material and the conveyor belt must be varied in practice by changing the suction performance, as a consequence of which a not inconsiderable set-up cost is required in addition to specialist experience. Since the suction force acting from below pulls the sheet material onto the conveyor belt and subsequently pulls it onto the guide plate, both frictional heat and frictional wear are produced. The frictional heat encourages the generation of static electricity in the case of certain qualities of paper and quite particularly in the case of films. This is detrimental to the processing of the sheet material. The previously disclosed partial vacuum configurations are particularly unfavorable for the transverse supply of the sheet material in the case of so-called corner conveyor tables. The sheet, as it arrives in a transverse direction, is already caused to decelerate by the suction effect in the suction holes situated externally in the conveyor belt or by the longitudinal suction slots running along the conveyor belt, and for this reason a longer transport path is required for the alignment, as a consequence of which an increased need for space exists and higher machine-related costs are imposed.

Other configurations for the transport and alignment of sheet materials possess balls located in ball rails for the purpose of applying a loading to the sheets on the top side, for example as indicated in German patent DE 17 86 252 C3. The loading of the sheet material must be varied depending on the size of the sheet, the weight of the sheet, the rigidity of the sheet and the coefficient of friction of the sheet. This setting-up work is expensive and also calls for specialist knowledge and specialist experience. Moreover, the quality of alignment is affected in a negative fashion in the sense that the balls are caused to jump into the air by the arriving sheet, in particular in the case of thick or multi-layer products. Furthermore, sensitive papers or printed surfaces are damaged by the pressure of the balls, in that they form clearly visible lines or local point markings. The balls also pick up printing ink and dirt and accordingly require frequent cleaning, as a result of which the labor input in such configurations is increased.

A further configuration of the kind in question is previously disclosed in German patent DE 44 21 918. This provides for the conveyor belt to exhibit open transverse slots on its upper side carrying the sheet at least on the side facing towards the straightedge, in order for the upper half of the conveyor belt to run in a guide channel that is open in an upward direction, the upper side of which lies at the same height as the upper side of the conveyor belt, and for the open side of the transverse slots to be connected to the air suction device in such a way as to permit the flow to take place.

A uniform distribution of the suction effect over the entire surface of the conveyor belt, which transports the sheet is assured by the transverse slots. Guiding of the conveyor belt in the guide channel that is open in an upward direction is executed in such a way that the upper sides of the guide channel and the conveyor belt lie at approximately the same height. This ensures an exact supporting surface for the sheets that are to be transported and aligned, so that these are able without problem to perform the relative displacements required for alignment. The suction effect exerted on the sheets by the air suction device also makes its effect felt in the alignment process including in the case of very thin, flexible sheet material without impairing the alignment process, since the extraction of the air from the slots takes place at their lateral opening, as a consequence of which the suction force is low perpendicular to the conveyor belt. An additional consideration is the fact that the movement of the sheet material in relation to the straightedge is supported by the direction of flow generated in this way, and in particular when only the open sides of the transverse slots facing towards the straightedge are subjected to suction air or a net suction air flow is generated in this direction. It has been found that this solution also exhibits disadvantages, however, since the necessary extraction configurations are large and expensive in order to be able to utilize all the weights per unit area (from about 28 g/m$^2$ to 300 g/m$^2$) and formats that are used in folding. It is especially important in this case to ensure that it is possible for this purpose reliably to cover a broad partial vacuum range, for example from 100 to 0.1 mbar. The suction air generator in German patent DE 44 21 918, on the other hand, produces a relatively constant low partial vacuum.

SUMMARY OF THE INVENTION

It is accordingly an object of the invention to provide a configuration for the transport and simultaneous alignment of sheets that overcomes the above-mentioned disadvantages of the prior art devices of this general type, such that the reliable alignment of a sheet material in a very wide range of weights per unit area and dimensions supplied in a longitudinal or transverse direction is ensured, and that experience-dependent operating measures, time-consuming cleaning work and the risk of damage to the sheet material are avoided.

With the foregoing and other objects in view there is provided, in accordance with the invention, a configuration for transport and simultaneous alignment of sheets. The configuration contains a guide channel being open in an upward direction and having an upper side and a straightedge and at least one conveyor belt disposed slightly at an angle to the straightedge in a direction of movement of the sheets. The conveyor belt carries the sheets, has an upper side with transverse slots formed therein, and an upper half running in the guide channel. An air suction device fluidically communicates with the transverse slots for permitting an air flow to take place. A controller for controlling a supply of air in an area of the transverse slots, is provided.

The configuration in accordance with the invention is accordingly characterized in that control devices are provided to control the supply of air in the area of the transverse slots. The airflow in the area of the transverse slots is responsible for the force with which a sheet lying on the conveyor belt is pulled down and held securely. This force is variable, however, in view of the plurality of different sheets, which require to be handled by a configuration of the kind in question. The necessary holding force for a large-format, repeatedly folded sheet with a weight per unit area of 300 g/m$^2$ differs considerably from that required for a single, smaller sheet with a weight per unit area of 28 g/m$^2$. Damage may consequently even be caused to the lighter sheet if this were to be subjected to the same force as the large, heavy sheet, for example by the sheet being sucked between the teeth and being caused to crumple as a result. This can be prevented with suitable control devices, which control the airflow in the area of the transverse slots. Through the optimal adaptation of the air supply to create the correct ratio of static partial vacuum and dynamic partial vacuum or volumetric flow, it is possible without any problems to transport all the weights per unit area (from about 28 g/m$^2$ to 300 g/m$^2$) in all the necessary formats that are commonly encountered in folding, and to align them against a straightedge.

In an advantageous embodiment of the configuration in accordance with the invention, the control devices contain at least a throttle valve, which controls the air supply ahead of the transverse slots in the suction area for the air supply. The air in this case is led from a throttle gap and under a cover plate as far as the conveyor belt. The fact that the air supply from the surrounding environment is obstructed by the throttle gap and the relatively narrow gap between the cover plate and the carrier that the quantity of air that is extracted exceeds the quantity that is able to flow in. This results in the creation of a partial vacuum, among other things, in the transverse slots that are covered by the sheet, which partial vacuum is dependent on the width of the throttle gap. A very precise influence can be exerted on the air supply in the area of the transverse slots in this way. The partial vacuum is thus augmented to an increasing degree by throttling the air supply, so that even heavy sheets can be handled reliably.

In a further advantageous embodiment of the arrangement in accordance with the invention, the control devices contain at least a bypass valve, which opens or closes a bypass, through which ambient air is sucked into a fan in the air suction device by bypassing the area of the transverse slots. The air supply is reduced in this way, and the partial vacuum drops as a result in the area of the transverse slots, so that the retaining force on the sheets is also reduced. Even very light sheets can thus be handled reliably in this way. Above all, this results in that the fan in the air suction device can be operated in an effectively controllable speed range, including where small airflows are present in the area of the transverse slots.

In a further advantageous embodiment of the configuration in accordance with the invention, the control devices contain at least an electronic control unit, which controls the output of the air suction device depending on the characteristic values of the sheets, in particular by regulating the speed of the fan in the air suction device. It is also possible, by regulating the speed of the fan in the air suction device, to exert an influence on the air supply in the area of the transverse slots. The electronic control unit also enables the opening state of the throttle valve and/or the bypass valve to be influenced in a particularly advantageous fashion. Three different control mechanisms are thus available for performing the control function, which, when used in combination, permit the desired coverage of the entire required area of different sheets.

In a further advantageous embodiment of the configuration in accordance with the invention, a control specification for the control of the other control devices is incorporated in the electronic control unit, in which the control specification depends in particular on empirical data. The control unit advantageously exhibits a memory, in which the control specification is stored. This can be in the form either of a reference table or of an algorithm, which determines the optimal air supply for a particular sheet on the basis of various parameters, or some other control specification familiar to a person skilled in the art. It is easier in this way for the operator to perform possibly laborious and time-consuming settings in conjunction with a change of products. In addition, the control specification can also be of an autodidactic nature.

In a further advantageous embodiment of the configuration in accordance with the invention, the control specification controls the other control devices on the basis of the values relating to the weights per unit area and the formats of the sheets that are capable of being entered into the electronic controller. Advantageously, these are the only required values that are entered into the control unit by an operator at an interface, in order to permit the control specification to determine the ideal air supply in the area of the transverse slots. Operation of the configuration is particularly simple as a result, in particular since these parameters are typically always of a known value. It is also possible to provide for fixed control specifications for parameter pairings to be stored already and/or to be capable of being stored in the control unit, in order to be able to retrieve these conveniently in the event of the renewed occurrence of the parameter pairings, which can permit the even faster input of the parameters. Alternatively, or in addition, it is also possible to provide sensors, which determine some or all of these parameters.

In a further advantageous embodiment of the configuration in accordance with the invention, the control specification takes account of at least one of the following parameters for the control of the other control devices: static charge of the sheet, condition of the printing ink, surface roughness of the sheet, quantity of any powder from the printing process, sheet width, direction of the fibers, such as short grain and long grain of the sheet, speed of the sheet, sheet-to-sheet distance, and suction length of the suction wheel on the feeding device. A further improvement of the setting-up procedure in order to achieve an ideal air supply in the area of the transverse slots can be achieved in this way. In this case, too, it is also possible to make provision for specific, for example repetitive, parameter pairings to be capable of being stored in the controller, for example in a memory.

In a further advantageous embodiment of the configuration in accordance with the invention, the upper side of the guide channel lies essentially at the same height as the upper side of the conveyor belt. Therefore the sheet lies flat on the conveyor belt and that damage to the sheet is avoided.

In a further advantageous embodiment of the configuration in accordance with the invention, the suction air channel extends behind the transverse slots to such an extent that it presents the smallest possible flow resistance as a result. In this way, the air flows through the configuration with the smallest possible losses, as a consequence of which the power consumption by the configuration can be reduced and the processes in the area of the transverse slots are more readily controllable.

In a further advantageous embodiment of the configuration in accordance with the invention, the air suction device including the fan is capable of being displaced to enable adjustment to be effected for a particular format.

In a further advantageous embodiment of the configuration in accordance with the invention, the conveyor belt is a toothed belt, and the toothed belt exhibits in particular teeth that are rounded at the top.

Other features which are considered as characteristic for the invention are set forth in the appended claims.

Although the invention is illustrated and described herein as embodied in a configuration for the transport and simultaneous alignment of sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
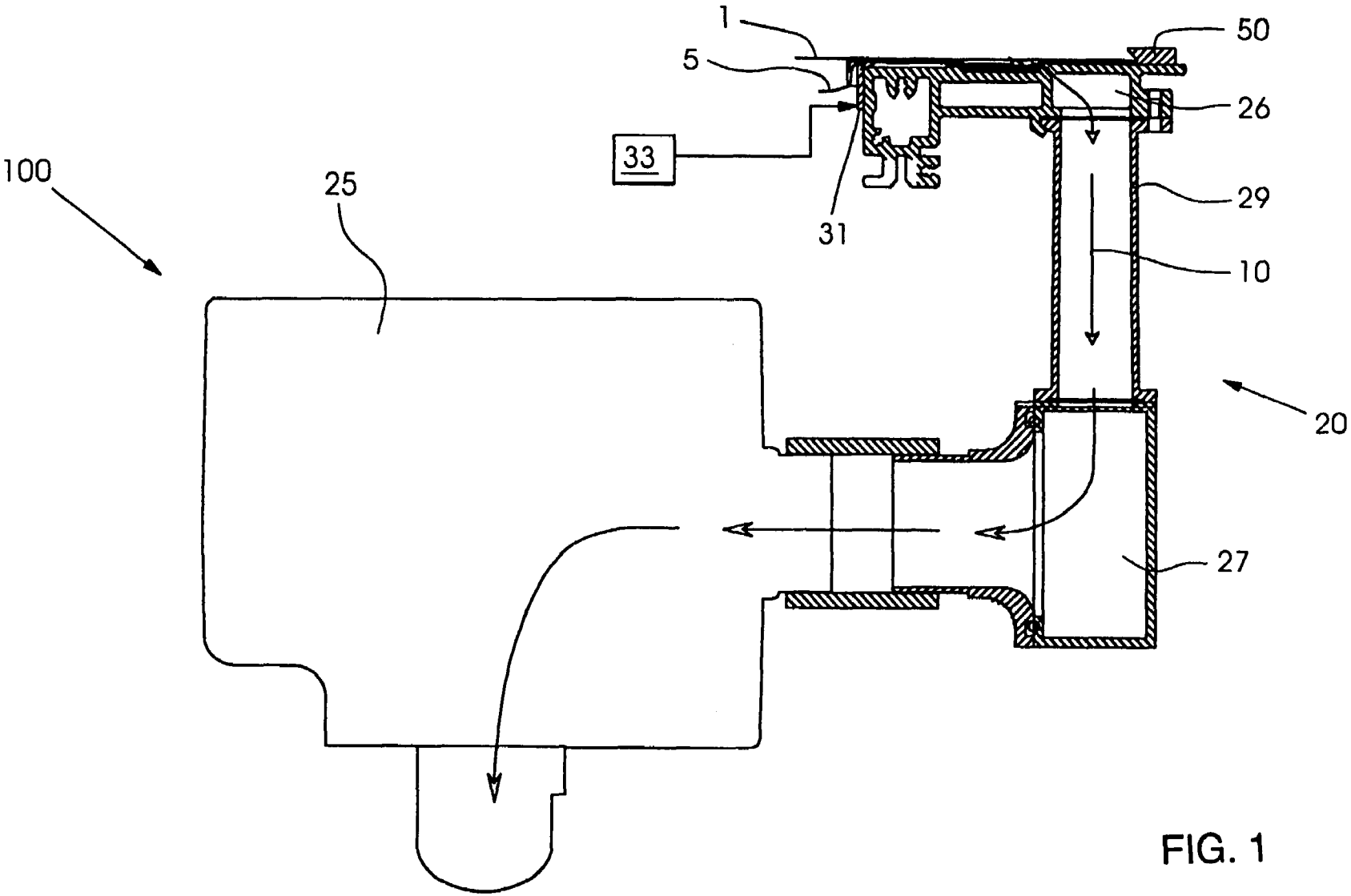
FIG. 1 is a diagrammatic, sectional view of an air suction device according to the invention.
Figure 3:
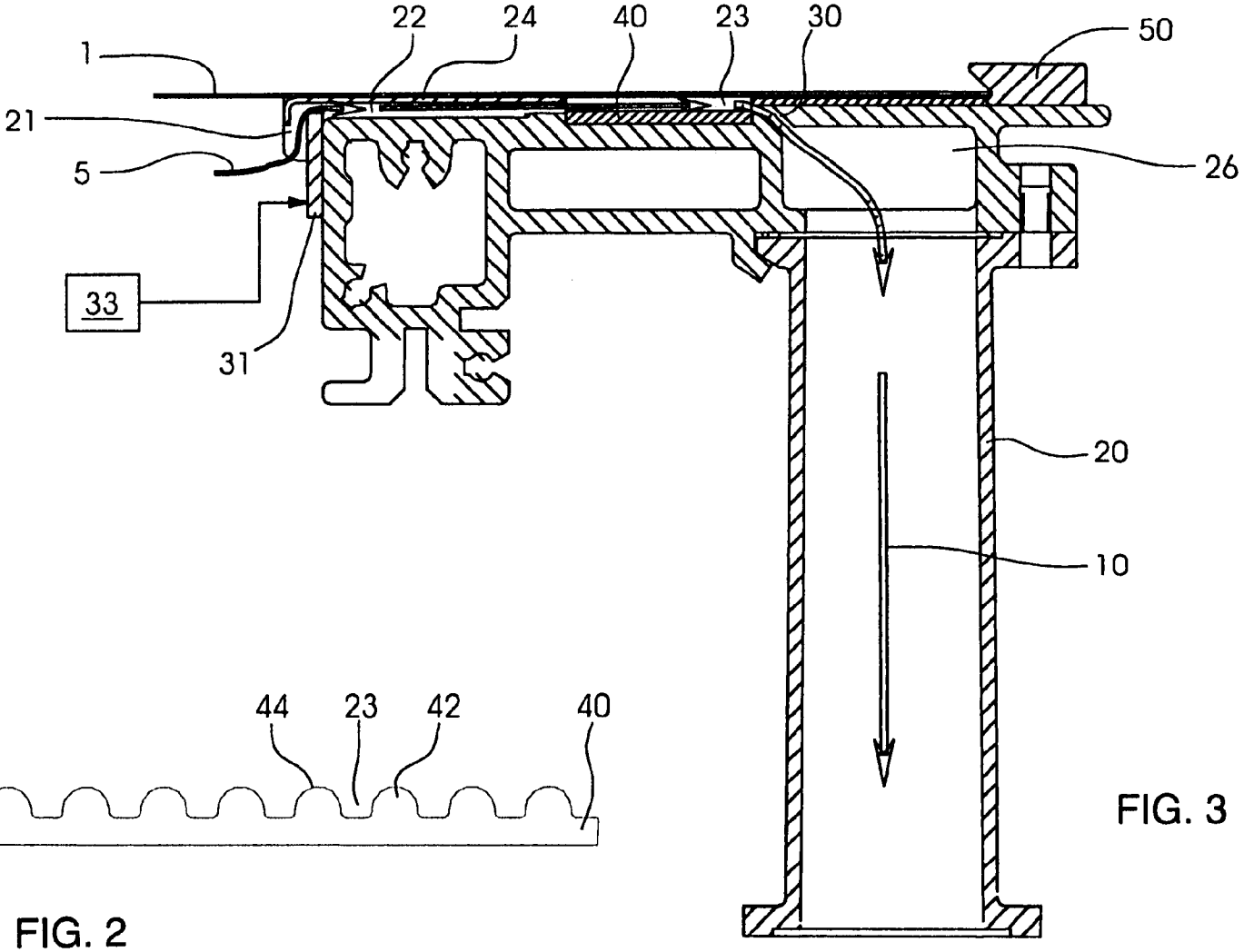
FIG. 3 is an enlarged, diagrammatic, cross-sectional view of a detail of the air suction device in an area of transverse slots of the conveyor belt.
Figure 2:
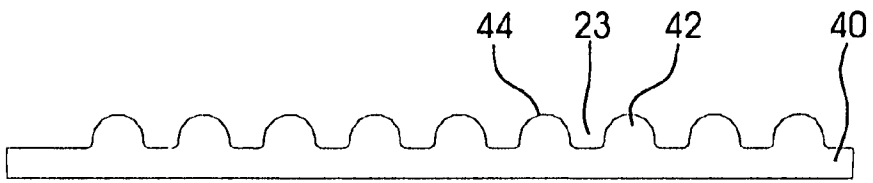
FIG. 2 is a diagrammatic, sectional view of a conveyor belt.

Referring now to the figures of the drawing in detail and first, particularly, to FIG. 1 thereof, there is shown an air suction device 100 that has an air channel 20 of a kind such that air (indicated by the arrows identified by the designations 5 and 10) is sucked by a fan 25, via a first suction chamber 26, suction intakes 29 and a second suction chamber 27, through transverse slots 23 of a toothed belt 40 (FIGS. 1 to 3). If the toothed belt 40 is open in an upward direction, i.e. if no sheet 1, 2, 3 is lying on it, the air from the surrounding environment is sucked in directly at an extraction slot 30.

As soon as a sheet 1, 2, 3 arrives on the toothed belt 40, the air in the area covered by the sheet 1, 2, 3 adopts the route indicated in FIG. 3: through a throttle gap 21, a gap 22 between a cover plate 24 and the carrier, through the toothed belt 40 into the first suction chamber 26 and onwards to the fan 25. By virtue of the fact that the air supply from the surrounding environment is restricted through the throttle gap 21 and the relatively narrow gap 22 between the cover plate 24 and the carrier, the quantity of air that is extracted exceeds the quantity that is able to flow in. This results in the creation, among other things, in the transverse slots 23 that are covered by the sheet 1, 2, 3, of a partial vacuum $P_{suction}$ in accordance with the formula:

$$P_{suction}=P_0-?/(2\times U^2-P_v),$$

where $P_0$ is the ambient pressure, ? is the density of the air, U is the velocity of flow of the air, and $P_v$ is the partial vacuum resulting from the flow losses. Therefore, the air pressure in the transverse slots 23 is smaller than the ambient pressure $P_0$. This difference in pressure gives rise to a force $F_P=(P_0-P_{suction})\times A$, which presses the sheets 1, 2, 3 from above against the toothed belt 40. A is used here to denote the total surface of the transverse slots 23 under the covering sheet 1, 2, 3. The contact force $F_p$, together with the coefficient of friction between the sheets 1, 2, 3 and the toothed belt 40, permits the sheet 1, 2, 3 to be transported with the toothed belt 40.

The partial vacuum, which arises in the transverse slots 23 of the toothed belt 40 and as such determines the contact force $F_P$, now depends in the first instance on the output of the fan 25 and the pressure loss $P_v$, which in this case is determined in the first instance by the width of the throttle gap 21. In addition, a small contribution to the partial vacuum is made by the dynamic element $?/(2\times U^2)$.

The air channel 20 is disposed in such a way that the air is able to flow with the smallest possible losses after flowing through the transverse slots 23 in the toothed belt 40. This is achieved by ensuring that the suction intakes 29 have the largest possible internal diameter, as well as the suction chambers 26, 27. The diameters are restricted by the available installation space.

Figure 4:
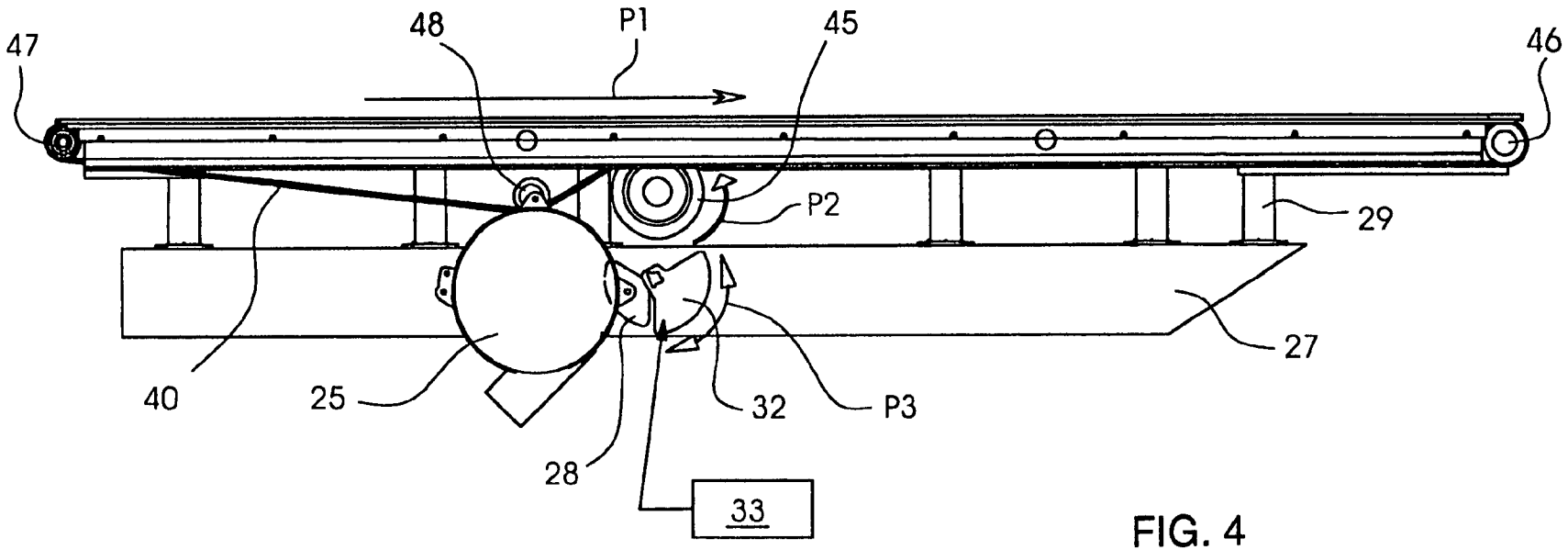
FIG. 4 is a diagrammatic, side-elevational view of the air suction device.

In order to be able to achieve the high partial vacuums required for heavy weights per unit area and broadsides with a single fan 25, and yet to achieve very small partial vacuums for thin printing paper while still maintaining an adequately safe speed, a bypass opening 28 can be opened (FIG. 4). When a bypass throttle 32 is moved in the direction indicated by the double arrow P3, the bypass opening 28 causes the fan 25, in spite of the high speeds, to extract only a small quantity of air from the area of the toothed belt 40 and to suck the greatest proportion of the air directly through the bypass opening 28, depending on the size of the still unobstructed bypass opening 28.

It is sufficient, as a rule, for a uniform partial vacuum to be generated for the entire length of the toothed belt 40 in the transverse slots 23 of the toothed belt 40. The present construction also offers the possibility, however, of subdividing the air channel 20 into three sections, in which the partial vacuums adopt different levels. This is achieved by varying the cross sections of the suction intakes 29 at an appropriate point, for example by non-illustrated throttle plates. Another subdivision into two or more sections is also conceivable.

As can be appreciated from FIG. 2, the toothed belt 40 exhibits teeth 42 with a rounded upper surface 44. By executing the upper surface 44 of the teeth 42 in this way, the contact surface of the sheet 1, 2, 3 on the toothed belt 40 is reduced, and the surface over which the partial vacuum is applied to the sheet 1, 2, 3 is accordingly increased. At the same time, thanks to the rounded areas, contact with the sheet is also more gentle than would be the case with sharp-edged corners.

The toothed belt pulley 45, which rotates in the direction indicated by the arrow P2 (see FIG. 4), drives the toothed belt 40 in such a way that a direction of movement of the sheets 1, 2, 3 from a non-illustrated feeding device located upstream to a non-illustrated folding station located downstream is established. The toothed belt 40 passes via deflector rollers 46, 47, a tension roller 48 and the toothed belt slot in the carrier. The nature of the toothed belt slot is such that the teeth are terminated at the top directly in line with the supporting surface. If the air suction device 100 is running, the toothed belt 40 that is subjected to a partial vacuum accepts the sheet 1, 2, 3 from the feeding device and passes it to the folding station after traveling over the alignment path.

Figure 5:
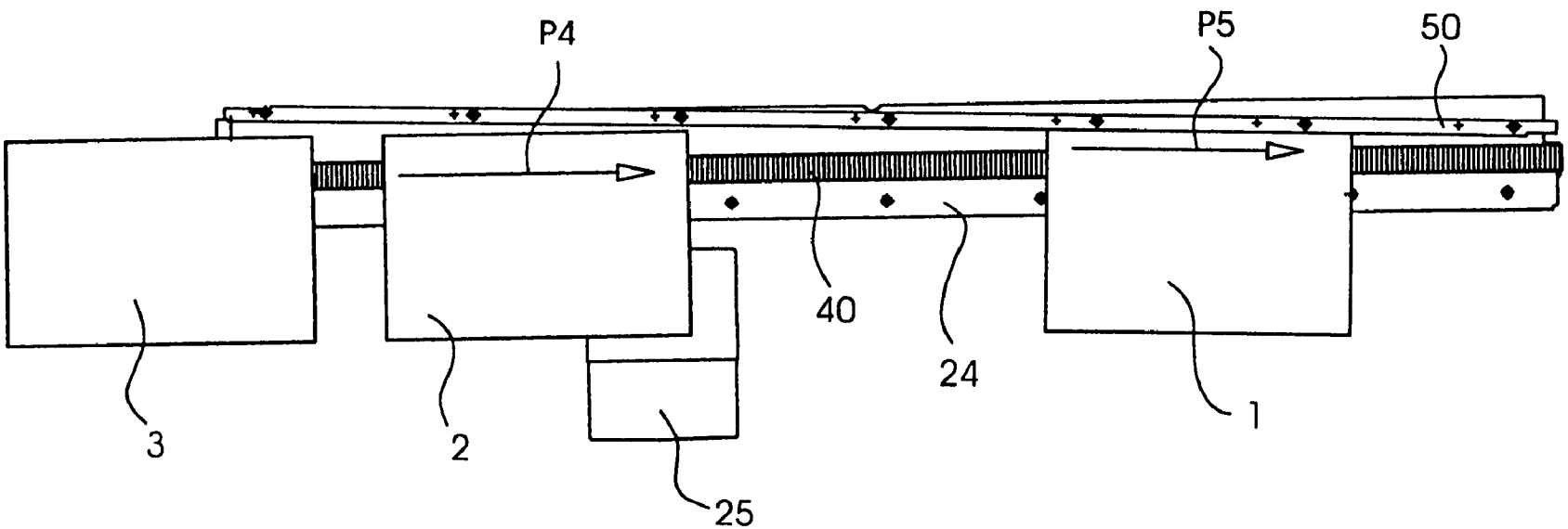
FIG. 5 is a diagrammatic, plan view of the air suction device with sheets entering.

Illustrated in FIG. 5 is a plurality of sheets 1, 2, 3, which are aligned laterally by the straightedge 50. In the first place, the sheets 1, 2, 3 have a direction of movement as indicated by arrow P4 and which corresponds to the direction of the toothed belt 40. Given that the straightedge 50 is positioned at a right angle to the following folding station, and that the toothed belt 40 is guided at an angle to the straightedge 50, the sheet 1, 2, 3 approaches the straightedge 50 in a linear fashion. As soon as the sheet 1, 2, 3 touches the straightedge 50, a relative movement takes place between the sheet 1, 2, 3 and the toothed belt 40 perpendicular to the path of the sheet. The sheet 1, 2, 3 aligns itself with the straightedge 50 in this way and is transferred to the folding station with this alignment in a direction of movement which now runs parallel to the straightedge 50 and is indicated with the arrow P5 in FIG. 5.

A critical consideration in the alignment procedure is that the sheet 1, 2, 3 must remain flat, that is to say no arching of the sheet 1, 2, 3 must occur between the toothed belt 40 and the straightedge 50, and that the sheet 1, 2, 3 must also be held sufficiently firmly by the toothed belt 40 for it not to slide backwards (towards the feed device). The sheet will arch between the straightedge 50 and the toothed belt 40 if the partial vacuum under the sheet 1, 2, 3 is too great. The sheet 1, 2, 3 will slide backwards if the partial vacuum under the sheet 1, 2, 3 is too small. The proper alignment of the sheet 1, 2, 3 thus depends critically on the precise regulation of the partial vacuum in the area of the transverse slots 23.

The devices for control represented by the throttle valve 31 and the bypass throttle 32 are controlled by a controller 33. The controller 33 also regulates the speed of the fan 25. The actuating variables for this purpose are monitored by the controller 33 via reference tables for different parameters, or are calculated by a suitable algorithm on the basis of the different parameters, or are determined by some other comparable methods that are familiar to a person skilled in the art. As far as the parameters are concerned, these include in particular the weight per unit area of the sheet 1, 2, 3, the width of the sheet 1, 2, 3, the static charge of the sheet 1, 2, 3, the condition of the printing ink, the surface roughness of the sheet, the quantity of the powder from the printing process, the direction of the fibers, such as short grain and long grain of the sheet 1, 2, 3, the speed of the sheet, the distance of the sheet 1, 2, 3 to the sheet 1, 2, 3, and the suction length generated by the suction wheel on the sheet, although this list is not exclusive.

The suitable control of the air suction device 100, which in this case also includes the control of the fan 25, requires the operator to incur the smallest possible set-up cost, and the values that are to be set to be capable of being determined readily, that is to say they must not be dependent on values drawn from past experience. With regard to the automation of folding machines, the settings are accordingly automated, are capable of being stored and can be retrieved in the event of a repeat order. All of this does not apply, incidentally, to the ball rails that are used elsewhere.

Ideally, only a small number of particularly influential parameters are interrogated by the user in this case, for example the weight per unit area of the sheet 1, 2, 3 and the width of the sheet. On the other hand, the devices for control are executed in such a way that manual intervention in the control function is also possible, for instance the manual opening or closing of the throttle valve 31 or the bypass throttle 32, in order to be able to include the less important parameters by hand.

The partial vacuum is controlled in the present construction via a pulse width modulation (PWM) signal, which is generated by an algorithm on the basis of the weight per unit area and the sheet width. In addition, the PWM signal of the fan can also be monitored manually. These inputs can be stored and can be retrieved in the event of a repeat order. Consideration should also be given to the possibility that the environmental conditions of the company concerned may have varied between one order and the next, so that the PWM signal may require to be monitored manually once again.

This application claims the priority, under 35 U.S.C. § 119, of German patent application No. 10 2004 022 141.3, filed May 5, 2004; the entire disclosure of the prior application is herewith incorporated by reference.

We claim:

1. A configuration for transport and simultaneous alignment of sheets, the configuration comprising:

a guide channel being open in an upward direction and having an upper side and a straightedge;

at least one conveyor belt disposed slightly at an angle to said straightedge in a direction of movement of the sheets, said conveyor belt carrying the sheets and having an upper side with transverse slots formed therein, said conveyor belt having an upper half running in said guide channel;

an air suction device fluidically communicating with said transverse slots for permitting an air flow to take place in a flow direction; and a controller including at least a throttle valve disposed upstream of said transverse slots in said flow direction for controlling a supply of air in an area ahead of said transverse slots for the supply of air.

2. The configuration according to claim 1, wherein:

said air suction device has a fan; and said controller includes at least a bypass valve, for opening a bypass opening, through which ambient air is sucked into said fan by bypassing said area of said transverse slots.

3. The configuration according to claim 2, wherein said controller contains at least an electronic control unit for controlling an output of said air suction device depending on characteristic values of the sheets.

4. The configuration according to claim 3, wherein said electronic control unit also controls an opening state of said throttle valve and/or said bypass valve.

5. The configuration according to claim 3, wherein said electronic control unit has a control specification that depends on empirical data.

6. The configuration according to claim 5, wherein the control specification of said electronic control unit controls said throttle valve and/or said bypass valve on a basis of values relating to weights per unit area and formats of the sheets that are capable of being entered into said electronic control unit.

7. The configuration according to claim 6, wherein the control specification takes account of at least one of the following parameters for the control of said throttle valve and/or said bypass valve: static charge of the sheet, condition of printing ink, surface roughness of the sheet, quantity of any powder from a printing process, direction of fibers of the sheet including a short grain and a long grain of the sheet, speed of the sheet, distance of sheet to sheet, and suction length of a suction wheel on a feeding device.

8. The configuration according to claim 1, wherein said upper side of said guide channel lies substantially at a same height as said upper side of said conveyor belt.

9. The configuration according to claim 1, wherein:

said air suction device has a fan; and said controller contains at least an electronic control unit for regulating a speed of said fan for controlling an output of said air suction device depending on characteristic values of the sheets.

10. A configuration for transport and simultaneous alignment of sheets, the configuration comprising:

a carrier having a guide channel formed therein, said guide channel being open in an upward direction and having an upper side and a straightedge;

at least one conveyor belt disposed slightly at an angle to said straightedge in a direction of movement of the sheets, said conveyor belt carrying the sheets and having an upper side with transverse slots formed therein, said conveyor belt having an upper half running in said guide channel;

an air suction device fluidically communicating with said transverse slots for permitting an air flow to take place in a flow direction;

a cover plate disposed on said carrier defining a gap between said cover plate and said carrier upstream of said transverse slots in said flow direction, said gap opening into a lateral side of said guide channel, and said gap being substantially coplanar with said transverse slots; and a controller for controlling a supply of air to said gap in an area of said transverse slots.

11. The configuration according to claim 10, wherein said controller includes at least a throttle valve for controlling the supply of air to said gap.

12. The configuration according to claim 11, wherein:

said air suction device has a fan; and said controller includes at least a bypass valve, for opening a bypass opening, through which ambient air is sucked into said fan by bypassing said area of said transverse slots.

13. The configuration according to claim 12, wherein said controller contains at least an electronic control unit for controlling an output of said air suction device depending on characteristic values of the sheets.

* * * * *